United States Patent [19]

Junkers

[11] Patent Number: 4,974,476

[45] Date of Patent: Dec. 4, 1990

[54] FLUID-OPERATED WRENCH

[76] Inventor: John K. Junkers, 7 Arrowhead La., Saddle River, N.J. 07458

[21] Appl. No.: 226,407

[22] Filed: Jul. 29, 1988

[51] Int. Cl.[5] ..... B25B 13/00

[52] U.S. Cl. ..... 81/57.39

[58] Field of Search ..... 81/57.39, 57.44, 58.2

[56] References Cited

U.S. PATENT DOCUMENTS

| | | | |
|---|---|---|---|
| 4,446,762 | 5/1984 | Junkers | 81/57.39 |
| 4,513,645 | 4/1985 | Grabovac et al. | 81/57.39 |
| 4,591,288 | 5/1986 | Schmidek et al. | 81/57.39 X |
| 4,663,997 | 5/1987 | Junkers | 81/57.39 |
| 4,706,526 | 11/1987 | Junkers | 81/57.39 |

FOREIGN PATENT DOCUMENTS

| | | | |
|---|---|---|---|
| 2014495 | 8/1979 | United Kingdom | 81/57.39 |

*Primary Examiner*—James G. Smith
*Attorney, Agent, or Firm*—Michael J. Striker

[57] ABSTRACT

A fluid-operated wrench as comprising a cylinder-piston unit with a cylinder having a guide and a piston performing an active stroke in one direction and a reverse stroke in an opposite direction, an engaging member arranged to engage a threaded connector to be tightened or loosened, and formed so that its one circumferential portion engages the threaded connector while its remaining circumferential portion is open, and a reaction member arranged to abut against an adjacent object and spaced from the engaging member in the direction of the active stroke so that a reaction force during the active stroke tends to push the guide onto the engaging member and to reliably hold the latter on the threaded connector.

5 Claims, 4 Drawing Sheets

FLUID-OPERATED WRENCH

BACKGROUND OF THE INVENTION

The present invention relates to a fluid-operated wrench.

Fluid-operated torque wrenches are known in the art. All hydraulic torque tools provided with a cylinder-piston unit operate so that when a piston moves in one direction to act on an engaging member which engages a threaded connector for loosening or tightening the latter, a cylinder of the cylinder-piston unit moves in an opposite direction and is made to abut against a stationary object. The engaging member which is connected with the threaded connector to be turned is subjected to the pulling force which tends to pull the engaging member from the threaded connector to be turned. In other words, when the cylinder of the cylinder-piston unit reacts against a stationary object, the force opposite to the reaction force pulls the engaging member laterally or radially from the axis of the threaded connector to be tightened or loosened. It is to be understood that when the engaging member is formed as a socket or box wrench which surrounds a threaded connector over its entire circumference, this pulling force does not cause any problems. However, when the engagement member is formed as an open-end wrench or in other words, extends only over a part of the circumference of the threaded connector, the pulling force urges the engaging member from the threaded connector.

SUMMARY OF THE INVENTION

Accordingly, it is an object of the present invention to provide a fluid-operated wrench which avoids the disadvantages of the prior art.

More particularly, it is an object of the present invention to provide a fluid-operated wrench which has an engaging member which is partially open and nevertheless is reliably held on a threaded connector to be tightened or loosened without slipping off from the latter.

In keeping with these objects and with others which will become apparent hereinafter, one feature of the present invention resides, briefly stated, in a fluid-operated wrench which has a cylinder-piston unit having a cylinder and a piston, the cylinder being provided with guiding means, the piston being movable in the cylinder in one direction to perform an active stroke and in an opposite direction to perform a reverse stroke, engaging means arranged to engage a threaded connector to be tightened or loosened, the engaging means being formed so that over one part of its circumference it embraces the threaded connector and over a remaining part of its circumference it is open, the engaging means being slidingly guided in the guiding means of the cylinder and being connected with the piston so as to be turned by the piston during the active stroke and to thereby turn the threaded connector, and reacting means connected with the cylinder and arranged to engage an adjacent object, the reacting means being spaced from the engaging means in a direction of the active stroke so that during the active stroke a reaction force tends to push the guiding means onto the engaging means so as to assure reliable engagement of the engaging means with the threaded connector to be turned.

When the fluid-operated wrench is designed in accordance with the present invention, during the active stroke a reaction force, contrary to the known wrenches, urges the guiding means of the cylinder onto the engaging member so that the latter is reliably held on a threaded connector to be tightened or loosened.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
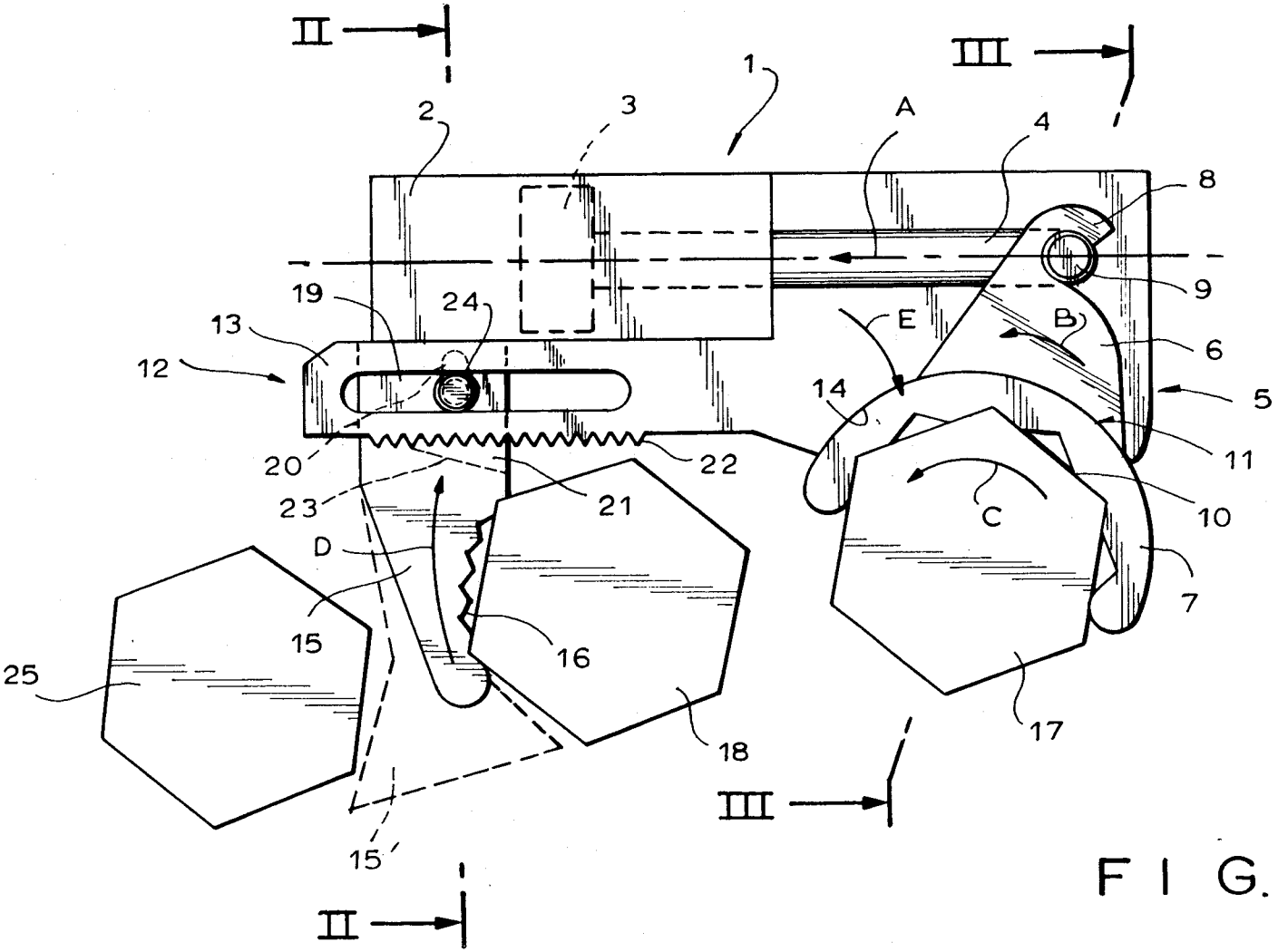
FIG. 1 is a side view of a fluid-operated wrench in accordance with one embodiment of the present invention.

A fluid-operated wrench in accordance with the embodiment shown in FIG. 1 has a cylinder-piston unit which is identified as a whole with reference numeral 1. The cylinder-piston unit 1 includes a cylinder 2 and a piston 3 which reciprocates in the cylinder 2. The cylinder 2 has not shown fluid medium inlet and outlet for connecting the cylinder to a fluid supply and a tank, respectively, therefore provide the reciprocation of the piston in the cylinder 2.

A piston rod 4 has a first end which is fixedly connected with the piston 3 and a second end which is spaced from the piston 3 and is pivotablly connected with an engaging member identified as a whole with reference numeral 5. The engaging member 5 has a connecting portion 6 and an engaging portion 7.

The connecting potion 6 of the engaging member 5 has a hook-shaped projection 8 which is pivotably connected with the second end of the piston rod 4, for example by means of a pivot pin 9. The engaging portion 7 of the engaging member 5 is substantially arcuate and formed as a segment which extends only over a part of a circumference, so that a remaining part of the circumference is open. In other words, the engaging portion 7 forms a so-called "open end" tool. As can be seen from the drawing, an inner surface of the engaging portion 7 which is adaped to face a threaded connector is provided with a plurality of teeth for reliable engagement with the same. An outer surface of the engaging portion 7, which is adapted to face away of a threaded connector, is circular and forms a sliding surface 11.

Figure 2:
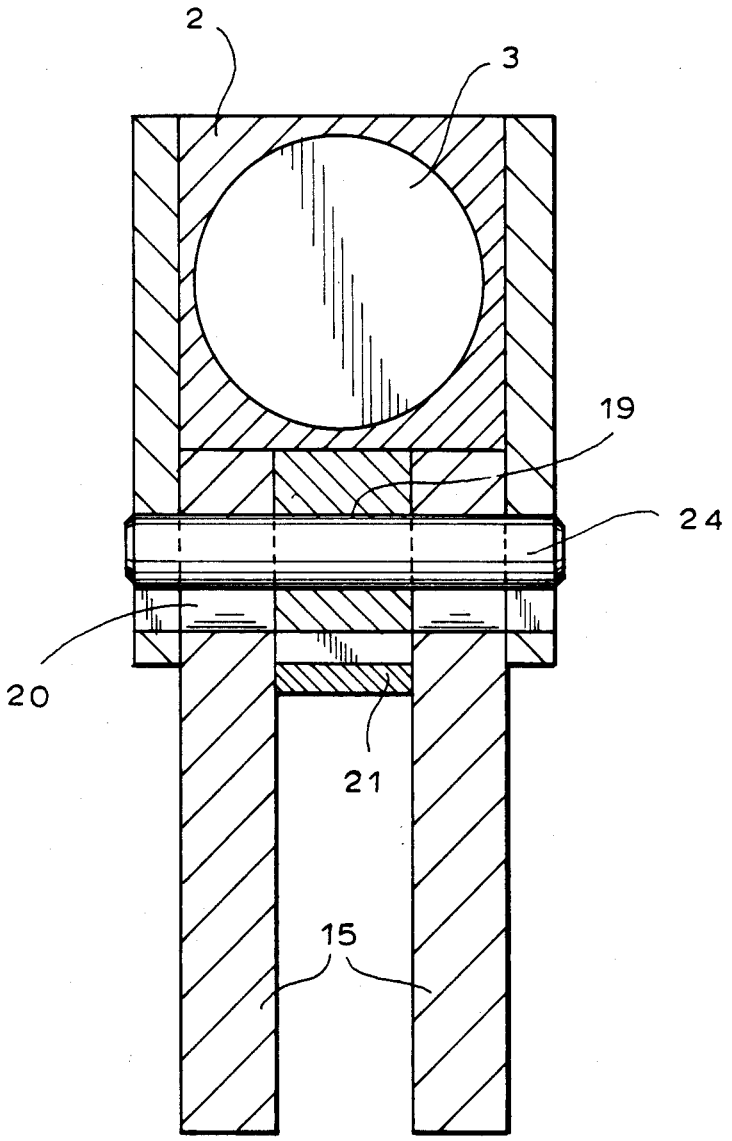
FIG. 2 is a view showing a section taken along the line II—II in FIG. 1.
Figure 3:
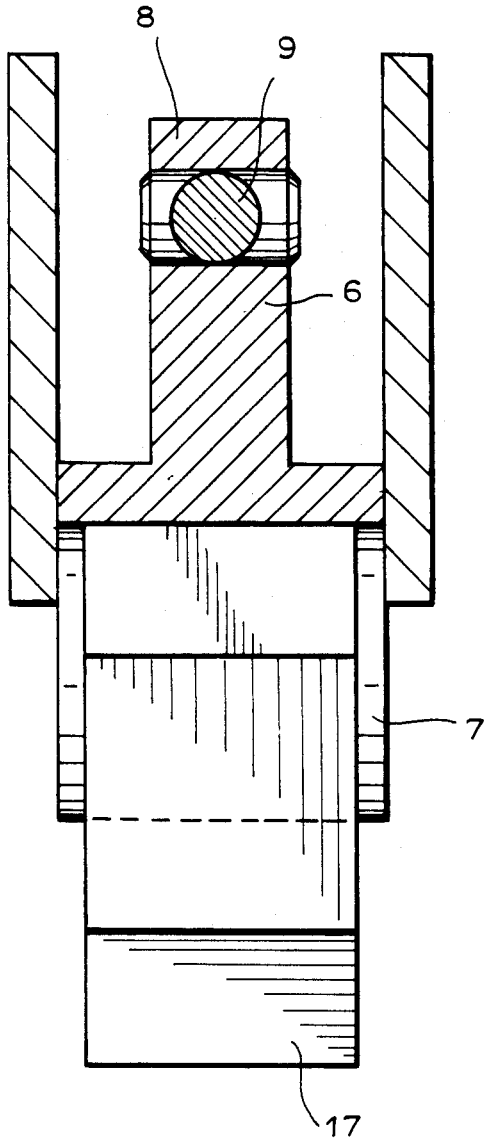
FIG. 3 is a view showing a section taken along the line III—III in FIG. 1.

The fluid-operated wrench is further provided with a reactor 12 for cooperating with adjacent objects during operation of the wrench. The reactor has a connecting portion which is identified with reference numeral 13 and is fixedly connected with the cylinder 2 of the cylinder-piston unit 1 for example by not shown threaded elements. The connecting portion 13 of the reactor 12 has a guiding surface 14 cooperating with the sliding surface 11 of the engaging portion 7 of the engaging member 5. The reactor 12 further has an abutting portion 15 arranged to engage directly an adjacent object. The abutting portion 15 is provided with a plurality of teeth 16 for engaging with an adjacent object. The abutting portion 15 can have two abutting members 15' arranged at a distance from one another, as shown in FIG. 2.

During the operation of the fluid-operated wrench shown in FIG. 1, the piston 3 with the piston rod 4 performs an active stroke in a direction identified with arrow A and a reverse stroke in an opposite direction. As can be seen from the drawings, the reactor 12 and in particular its abutting portion 15 which engages the adjacent object is spaced from the engaging member 5 and particularly from its engaging portion 7 in the direction A of the active stroke of the piston 3 with the piston rod 4. During the active stroke the piston rod 4 displaces the connecting portion 6 of the engaging member 5 and turns the engaging portion 7 of the same in direction of the arrow B. The sliding surface 11 of the engaging member 5 slides over the guiding surface 14 of the reactor 12. A threaded connector, for example a nut 17 is turned by the engaging portion 7 in direction of the arrow C. The abutting portion 15 of the reactor 12 engages an adjacent object, for example an adjacent nut 18. During the active stroke a reaction force acts in direction of the arrow D and pushes the guiding surface 14 of the reactor 12 onto the sliding surface 11 of the engaging member 5 and therefore the engaging member is pushed onto the nut 7 so that it cannot slip off from the latter.

As can be seen from FIG. 1, the abutting portion 15 can be connected with the connecting portion 13 of the reactor member in an adjustable manner, in order to adjust a distance between the abutting portion 15 of the reactor 12 and engaging portion 7 of the engaging member 5 in dependence on the distance between the nut 17 to be turned and the adjacent nut 18. The connecting portion 13 of the reactor 12 is provided with an elongated hole 19 extending substantially parallel to the axis of the cylinder-piston unit, while the abutting portion 15 is provided with a small elongated hole 20 extending transversely to this axis. The abutting portion 15 also has a cutout 21. The connecting portion 13 and the abutting portion 15 of the reactor 12 have cooperating threads 22 and 23. For adjusting the distance between the abutting portion 15 of the reactor 12 and the engaging portion 7 of the engaging member 5, a screw 24 is loosened, the abutting portion 15 is moved somewhat downwardly to disengage its thread 23 from the thread 22 of the connecting portion 13, and then the abutting portion 15 is moved in the axial direction toward or away of the engaging portion 7 of the engaging member 5 by a required distance. Then the abutting portion 15 is moved upwardly so that its thread 23 engages the thread 22 of the connecting portion 13, and the screw 24 is tightened.

As can be seen from FIG. 1, the reactor 12 can have a somewhat different abutting portion 15'. It is shown in dotted lines and has two opposite engaging surfaces arranged so that one surface faces toward the engaging member 5, while the other surface faces away of the engaging member 5. Both surfaces also can be provided with teeth. The abutting portion 15' is wedge shaped. It can be used for engaging a nut not only at its one side, such as the nut 18, but also it can engage another nut, such as a nut 25 located at its side opposite to the engaging member 5. On the other hand, it can simultaneously engage both nuts 18 and 25.

In the embodiment shown in FIG. 1, the cylinder-piston unit 1 and the engaging member 5 are arranged so that the active stroke of the piston 3 with the piston rod 4 in the direction A is a pulling stroke such that the engaging member 5 is pulled by the piston rod 4. Here the cylinder 2 of the cylinder-piston unit 1 is spaced from the engaging member 5 in the direction A of the active stroke.

Figure 4:
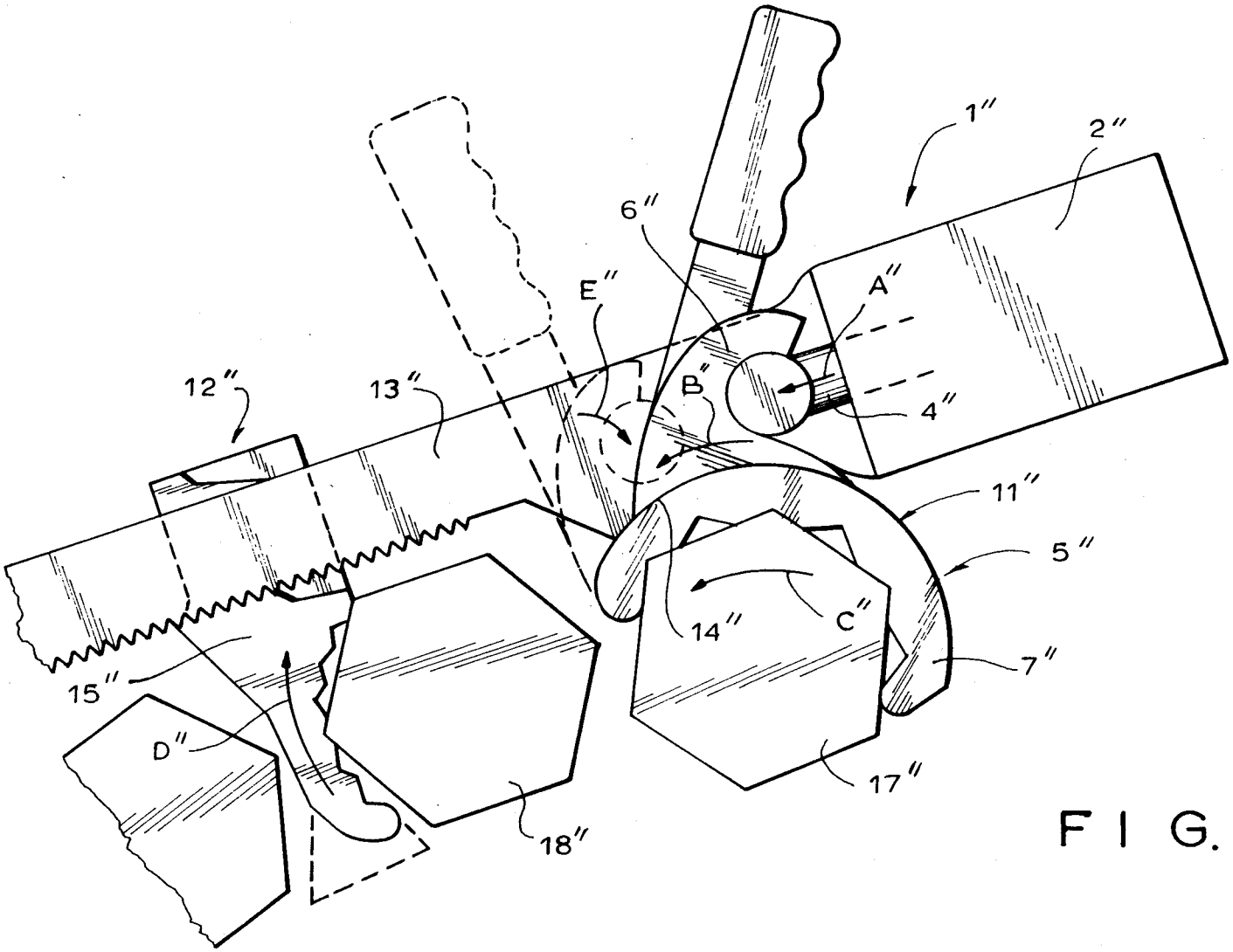
FIG. 4 is a view showing another embodiment of the present invention.

FIG. 4 shows the fluid-operated wrench in accordance with another embodiment of the invention. In this embodiment the cylinder-piston unit 1'' and the engaging member 5'' are arranged so that an active stroke of the cylinder-piston unit is performed in direction of the arrow A'' by pushing the piston with the piston rod 4'' out of the cylinder 2''. In this embodiment, the reactor 12'' is again spaced from the engaging member 5'' in the direction A'' of the active stroke. The cylinder 2'' of the cylinder-piston unit 1'' is spaced from the engaging member 5'' in a direction which is opposite to the direction A'' of the active stroke. The connecting portion 13'' of the reactor 12'' extends here through the cutout of the abutting portion 15'' of the same. As can be seen from the drawings, the reaction force acts in the direction of the arrow D'' and again pushes the guiding surface 14'' of the reactor 12'' in direction of the arrow E'' onto the sliding surface 1'' of the engaging portion 7'' of the engaging member 5'', thus pushing the engaging member 5'' onto the nut 17''.

It will be understood that each of the elements described above, or two or more together, may also find a useful application in other types of constructions differing from the types described above.

While the invention has been illustrated and described as embodied in a fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated wrench, comprising a cylinder-piston unit having a cylinder and a piston, said cylinder being provided with guiding means, said piston being movable in said cylinder in one direction to perform an active stroke and in an opposite direction to perform a reverse stroke; engaging means arranged to engage a threaded connector to be tightened or loosened, said engaging means being formed so that over one part of its circumference it embraces the threaded connector and over a remaining part of its circumference it is open, said engaging means being slidingly guided in said guiding means of said cylinder and being connected with said piston so as to be turned by said piston during said active stroke and to thereby turn the threaded connector; and reacting means connected with said cylinder and arranged to engage an adjacent object, said reacting means being spaced from said engaging means in a direction of said active stroke so that during said active stroke a reaction force tends to push said guiding means onto said engaging means so as to assure reliable engagement of said engaging means with the threaded connector to be turned, said reacting means including a hook element which is formed as a double-hook having one connecting surface which faces towards said engaging means and another connecting surface which faces away of said engaging means so as to be connected with an adjacent object at either side thereof.

2. A fluid-operated wrench as defined in claim 1, wherein said cylinder of said cylinder-piston means is located relative to said engaging means at a side of the latter facing away of said reacting means, so that said piston performs said active stroke by extending from said cylinder and pushing said engaging means away of said cylinder.

3. A fluid-operated wrench, comprising a cylinder-piston unit having a cylinder and a piston, said cylinder being provided with guiding means, said piston being movable in said cylinder in one direction to perform an active stroke and in an opposite direction to perform a reverse stroke; engaging means arranged to engage a threaded connector to be tightened or loosened, said engaging means being formed so that over one part of its circumference it embraces the threaded connector and over a remaining part of its circumference it is open, said engaging means being slidingly guided in said guiding means of said cylinder and being connected with said piston so as to be turned by said piston during said active stroke and to thereby turn the threaded connector; and reacting means connected with said cylinder and arranged to engage an adjacent object, said reacting means being spaced from said engaging means in a direction of said active stroke so that during said active stroke a reaction force tends to push said guiding means onto said engaging means so as to assure reliable engagement of said engaging means with the threaded connector to be turned, said cylinder of said cylinder-piston unit being located relative to said engaging means at a side of said engaging means facing toward said reacting means so that said piston performs said active stroke by retracting into said cylinder and pulling said engaging means towards said cylinder.

4. A fluid-operated wrench as defined in claim 1, wherein said reacting means includes a hook element which is adapted to be connected with the adjacent object.

5. A fluid-operated wrench as defined in claim 1, wherein said reacting means includes a connecting part connected with said cylinder-piston unit and a hook part adapted to be connected with the adjacent object, said hook part of said reacting means being adjustable relative to said connecting part.

* * * * *